United States Patent [19]

von der Eltz et al.

[11] Patent Number: 4,737,157

[45] Date of Patent: Apr. 12, 1988

[54] RAPID EXHAUST PROCESS FOR DYEING WOOL WITH REACTIVE DYES: ACID ADDED AT 95°-106° C.

[75] Inventors: Hans-Ulrich von der Eltz, Frankfurt am Main; Karl-Heinz Röstermundt, Eschborn; Klaus Türschmann, Hofheim am Taunus, all of Fed. Rep. of Germany

[73] Assignee: Hoechst Aktiengesellschaft, Frankfurt am Main, Fed. Rep. of Germany

[21] Appl. No.: 942,246

[22] Filed: Dec. 16, 1986

[30] Foreign Application Priority Data

Dec. 18, 1985 [DE] Fed. Rep. of Germany ..... 3544795

[51] Int. Cl.[4] ..... D06M 15/26; D06P 1/38; D06P 3/14

[52] U.S. Cl. ..... 8/543; 8/400; 8/533; 8/549; 8/917

[58] Field of Search ..... 8/543, 549

[56] References Cited

U.S. PATENT DOCUMENTS

| | | | |
|---|---|---|---|
| 3,890,091 | 6/1975 | Cathelin et al. | 8/495 |
| 3,930,795 | 1/1976 | Fuchs et al. | 8/543 |
| 3,937,611 | 2/1976 | Fuchs et al. | 8/543 |
| 4,304,566 | 12/1981 | von der Eltz et al. | 8/533 |
| 4,444,564 | 4/1984 | Salathe et al. | 8/588 |

FOREIGN PATENT DOCUMENTS

| | | |
|---|---|---|
| 0126042 | 11/1984 | European Pat. Off. . |
| 3544793 | 6/1987 | Fed. Rep. of Germany . |

*Primary Examiner*—A. Lionel Clingman
*Attorney, Agent, or Firm*—Connolly and Hutz

[57] ABSTRACT

The level dyeing of wool with reactive dyes and simultaneous endeavors to shorten the dyeing process appear to be incompatible. It has now been found, according to the invention, that in the course of the exhaustion process it is possible through metered addition of the acid required for fixation over a prolonged period to the dyebath which is already at the dyeing temperature and contains no acidic fixing agent to obtain a shortening in the total treatment time while at the same time safeguarding the levelness of the dyeings.

8 Claims, No Drawings

RAPID EXHAUST PROCESS FOR DYEING WOOL WITH REACTIVE DYES: ACID ADDED AT 95°-106° C.

The present invention relates to a process for the level dyeing of wool or of the wool portion of fiber blends by the exhaust dyeing technique in a weakly acidic medium with aqueous liquors of reactive dyes.

The dyeing of wool with reactive dyes per se is common knowledge. In general, the textile material is treated at pH values between 4 and 6.5 and at temperatures between 95° and 106° C. with aqueous liquors of these dyes until the dyebath is exhausted.

This way of dyeing wool is becoming increasingly important as the importance of wool with low- or non-felting finishes increases, since it is only with reactive dyes that it is possible to meet the high fastness requirements which are demanded of articles manufactured from wools thus modified, including the stringent requirements of machine washability (repeated wash at 60° C. with perborate-containing washing agents) without felting.

However, the dyeing of wool with reactive dyes presents in practice a problem which even today has not been completely solved, namely that of obtaining level dyeings in the course of conventional coloration measures. Various solutions have already been proposed (cf. German Pat. Nos. DE-C-2,244,089 and DE-C-2,244,240 and German Auslegeschrift No. DE-B-2,244,060), which in some instances rely on the use of leveling auxiliaries, but are usually based upon a special form of process control, for example maintaining accurately defined pH values, dyeing in temperature steps, or heating the dyebath with all the ingredients from the initial to the end temperature at a very slow rate, i.e. on a special way of bringing about the fixing conditions for dye and fiber material. Yet using extended heating-up phases is contrary to the present trend in dyeing machine construction, which points in the direction of evermore powerful machines which permit minimal heating-up times for setting the fixing temperature of only 10 to 15 minutes, the intention seeking to counteract inadequate levelness by cutting down on time.

All the abovementioned prior art dyeing methods require the reactive dyes and acid (fixing auxiliary) to be present together from the start in the exhaust bath already charged with the wool material to be dyed, the onset of the actual fixing process through interaction between reactive dye and wool fiber being controlled solely by raising the liquor temperature.

It is thus an object of the present invention to provide an exhaust dyeing method for wool or wool portions in fiber blends with reactive dyes which makes it possible, despite shortening the overall treatment times for the material to be dyed compared with the established dyeing methods of the same generic category, nonetheless to obtain level dyeings having adequate fastness properties.

This object is achieved according to the invention by heating the exhaust liquor which contains reactive dyes and possibly all other ingredients, but no acid or acid-donating agent required for fixing the dyes, together with the material to be dyed to the dyeing temperature within the range from 95° to 110° C. as rapidly as possible and in one step, then, on reaching the dyeing temperature and while maintaining appropriate isothermal conditions for dye fixation, adding (the) acid to the hot dyebath a little at a time over a prolonged period, and dyeing the wool at pH values between 4 and 6.5.

"As rapidly as possible" in connection with the defining clause of this invention means as rapidly as the output of the dyeing machines used will allow. "In one step" seeks to convey that the actual dyeing operation is effected without passing through incremental temperature conditions during the fixing of the dyes. "Under isothermal conditions" is to be understood as meaning that the temperature of liquor and textile material is kept constant during the treatment step of acid addition and the subsequent dyeing time.

The metering of the acid over a prolonged period into the dyeing liquor which is under fixing conditions for the dye can be carried out, in terms of quantities, not only linearly but also progressively, except that the time during which the bath temperature is kept constantly high in the course of the addition of the acid counts as part of the total dyeing time and consequently the total dyeing time is not prolonged by the process according to the invention. The pure metering time can vary from 15 to 60 minutes, giving a total dyeing time (including metering time) of 60 to 90 minutes.

If the acid fixing agent is metered in at a linear rate, a constant amount of acid is introduced into the dyebath per unit of time. This can be effected on the one hand by introducing the acid, in general diluted with water, either discontinuously in constant amounts and at constant intervals or, however, by adding the acid continuously in a constant amount per unit time.

Progressive metering of the acid fixing agent introduces a progressively increasing amount of acid into the dyebath per unit time as the metering time progresses, which can likewise be effected manually. In recent dispensing equipment this form of metering has been automated, so that all that is necessary is to set the desired steepness of the progression in accordance with a predetermined mathematical function, for example linearly, exponentially or parabolically.

The amount of acid to be added, like the dyeing time, depends on the desired depth of shade of the dyeing. In general, the amount will be 1 to 5% of 60% strength acetic acid, based on the weight of wool.

The dyeing technique of this invention gives satisfactory coloristic results not only on ordinary wool fibers, i.e. wool fibers which have not been pretreated with an antifelting finish, but also on chlorinated wools or wool which has been given a non- or low-felting finish by applying a polyacrylic or polyamine resin film. Wool or correspondingly composed fiber blends can, for the purposes of the present invention, be present in any processed state, i.e. in the form of loose fiber, slubbing, yarn, piece goods or even in the form of completed articles.

To dye wool fibers or the wool portion of fiber blends by the present process, suitable reactive dyes are the organic dyes, irrespective of the nature of their fiber-reactive group, which are known by this generic name. This class of dyes is referred to in the Colour Index, 3rd edition 1971 and supplements 1975, as "C.I. Reactive Dyes", and comprises chemical compounds of dye character which are capable of entering a covalent bond with OH- and/or NH-containing fibers. These dyes are predominantly those which contain at least one group capable of reaction with hydroxyl or amino groups in the fiber material of polyamide structure, a precursor thereof or a substituent capable of reaction with the abovementioned constituents of the fiber molecule. Suitable basic structures of the chromophoric system of these organic dyes are in particular those from the series of the azo, anthraquinone and phthalocyanine compounds, it being possible for the azo and phthalocyanine dyes to be either metal-free or metal-containing. Examples of reactive groups and precursors which form such reactive groups are epoxy groups, the ethyleneimide group, the vinyl grouping in the vinylsulfonyl or acrylic acid radical, and also the β-sulfatoethylsulfonyl group, the β-chloroethylsulfonyl group or the β-dialkylaminoethylsulfonyl group. Also suitable for this process are derivatives of the tetrafluorocyclobutyl series, for example of tetrafluorocyclobutylacrylic acid. Suitable reactive substituents in reactive dyes are those which are readily detachable and leave behind an electrophilic radical. Examples of suitable substituents in this respect are 1 to 3 halogen atoms on the following ring systems: quinoxaline, triazine, pyrimidine, phthalazine, pyridazine and pyridazone. It is also possible to use dyes having a plurality of identical or different reactive groups. Such reactive dyes of the kind defined above frequently have more than one sulfonic acid group (in addition to that in the reactive grouping of the dye) in the molecule; these sulfonic acid groups can be distributed over the chromophore in any desired way, but are preferably bonded to the aromatic radicals thereof.

To carry out the present invention, preference is given to using dyes of the vinylsulfonyl type with which the fiber reacts by an addition mechanism via the vinylsulfonyl form of the dye. It is also possible to use as coloring substances in the claimed process the conversion products of such known sulfonyl reactive dyes with, for example, methyltaurine, in which the reactive group is temporarily present in masked form.

The process itself is basically carried out as follows. The manner of metering the acid can be varied within wide limits, as is immediately clear from the metering times mentioned. In general, the acid is added in dilute form, which permits more suitably graduated metering:

The aqueous dyebath is made up with all ingredients, such as dye, assistants and possible chemicals, except the acid required, and together with the material to be dyed it is raised as rapidly as the equipment permits to the fiber-dependent dyeing temperature. Straight away the heating-up phase produces a time saving of 10 to 30 minutes compared with the conventional processes. Immediately on reaching this dyeing temperature the metered addition of the required acid is started. The addition can be effected a little at a time in accordance with a certain time schedule, as for example in Example 1 below, or continuously in accordance with a predetermined mathematical function (linearly or, for example, exponentially or parabolically) with a dispenser, for example of the type described in European Offenlegungsschrift No. EP-A2-0,126,042. Equipment of this type has recently become commercially available.

During the time the acid is added and for a certain time thereafter, the bath temperature is held constant. After the proposed dyeing time has ended, the dyeing is finished in the manner customary for wool.

The examples which follow are not intended to restrict the claimed process in any way, in particular not in respect of the reactive dyes used, by merely serve to illustrate the procedure of the present invention. The percentages given in these worked examples are based on the weight of the articles to which they refer, and in the case of wool are expressed relative to the dry state of the material to be dyed. The reactive dyes mentioned are used in commercially available form and constitution. Dyes which are conversion products of the sulfonyl reactive dyes with N-methyltaurine are present after the prescribed dissolving step in the structure reproduced by the respective formula.

EXAMPLE 1

To dye 80 kg of a wool knit which has been given a nonfelting finish by applying a polyimine resin, by the exhaust technique with a liquor ratio of 10:1, an aqueous bath at 40° C. is prepared in a dyeing machine with the following ingredients:

3% of the reactive dye of the formula

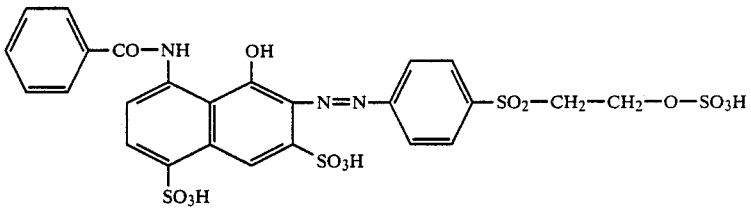

1% of a reactive dye obtained by converting the corresponding dye of the vinylsulfonyl type with N-methyltaurine and having the formula

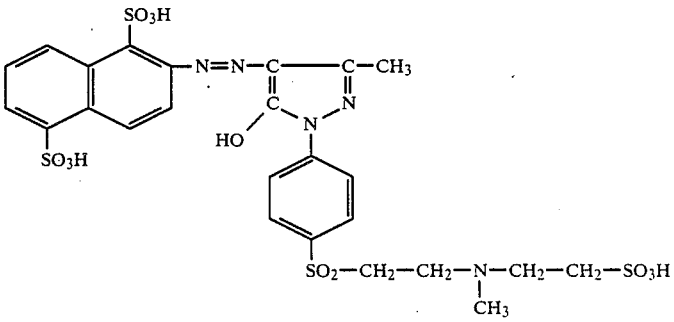

1.5% of an assistant mixture comprising the reaction product of 1 mol of stearylamine with 12 mols of ethylene oxide, to which triisobutyl phosphate has been added as an antifoam, and 2% of ammonium acetate.

For the time being, no acid is added. Under these conditions the bath has a pH value of 6.8.

The bath, which has been entered with the material to be dyed, is then set in circulation and raised to the dyeing temperature of 100° C. in the course of 10 minutes. Immediately on reaching this temperature the metered addition of in total 4% of 60% strength acetic acid, which corresponds to a liquid volume of 3.2 liters, is started. This metered addition is to be carried out at constant intervals in progressively larger amounts. To this end, the acid is diluted with water to a volume of 15 liters, and every 7 minutes the following quantities of this solution are added in accordance with the following schedule:

| At the start | after 7 | after 14 | after 21 | after 28 | minutes |
|---|---|---|---|---|---|
| 1 l | 2 l | 3 l | 4 l | 5 l | of solution |

During this measure the temperature of the bath is held at a constant 100° C. The acid introduced has therefore been preheated beforehand to approximately dyeing temperature.

After all the acid has been added, which has led to a bath pH of 4.7, the textile material is dyed at the same temperature for a further 30 minutes. The exhausted liquor, together with the dyed wool, is then cooled down, and the wool is rinsed with water and finished in conventional manner.

The result obtained on the knit is a brilliant red dyeing which has good wet fastness properties. Contrary to expectation, the levelness of the dyeing is very good.

EXAMPLE 2

60 kg of a fabric which comprises wool not pretreated with an antifelting finish and which has been readied for dyeing are exhaust-dyed in a beam dyeing apparatus with a liquor ratio of 15:1 as follows:

To this end, the material to be dyed is introduced into an aqueous liquor at 40° C. which contains as constituents 3% of the dye Reactive Blue 19 having the C.I. No. 61200, 1% of the reactive dye of the formula

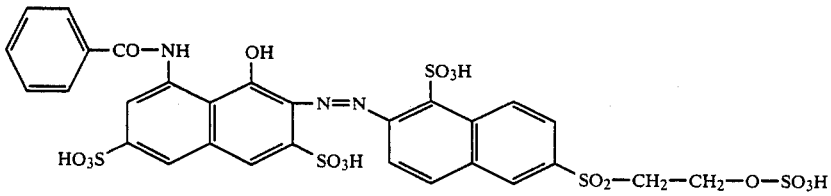

1.5% of the assistant mixture of Example 1, and

1% of ammonium acetate whereupon this dyebath is set in circulation and raised to the dyeing temperature of 100° C. in the course of 10 minutes. The liquor which is under fixing conditions then has continuously added to it with an ADC 100 dispenser from ADCON AB, Boras/Sweden 2.4 liters of 60% strength acetic acid, diluted with water to a volume of 20 liters, in the course of 45 minutes in amounts per unit time which progressively increase by 50%.

After a further 20 minutes of dyeing at 100° C., the dyeing has ended. The liquor and textile material are then cooled down, and the dyed wool is rinsed with water and finished in conventional manner.

The result obtained on the wool fabric is a very good level blue dyeing having good fastness properties.

EXAMPLE 3

120 kg of a wool yarn which has not been given a nonfelting finish and is in cheese form are to be exhaust-dyed in a fast black with a liquor ratio of 15:1:

To this end, an aqueous dyebath at 60° C. is charged with

5% of the dye Reactive Black 5 having the C.I. No. 20505, 0.5% of the reactive dye of the formula

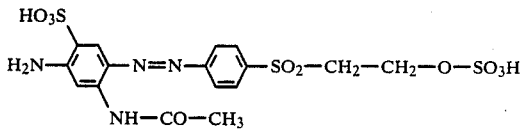

0.5% of the reactive dye of the formula

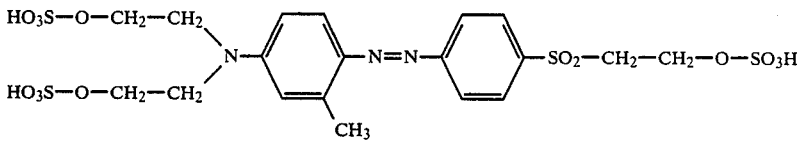

1% of the assistant mixture of Example 1, and

2% of ammonium acetate and together with the entered yarn is raised to the dyeing temperature of 106° C. in the course of 15 minutes. The acid is then metered in manually to the liquor under fixing conditions in linear portions at constant intervals. To this end 5.2 liters of 60% strength acetic acid are diluted with water to a volume of 10 liters, and 1 liter portions of this solution, which is expediently preheated are added to the bath every 3 minutes. After the last aliquot of acid has been added, the textile material is dyed at the stated temperature for a further 20 minutes, and then the bath, including the dyed material, is cooled down, and the dyed wool is rinsed with water and finished in conventional manner.

The desired fast and level black dyeing is obtained on the yarn.

EXAMPLE 4

200 kg of wool slubbing which has been given a non-felting finish by application of a polyacrylic resin film are to be exhaust-dyed in the pack system with a liquor ratio of 8:1.

To this end, an aqueous liquor at 40° C. is charged with 0.5% of a reactive dye obtained by conversion of the corresponding dye of the vinylsulfonyl type with N-methyltaurine and having the formula

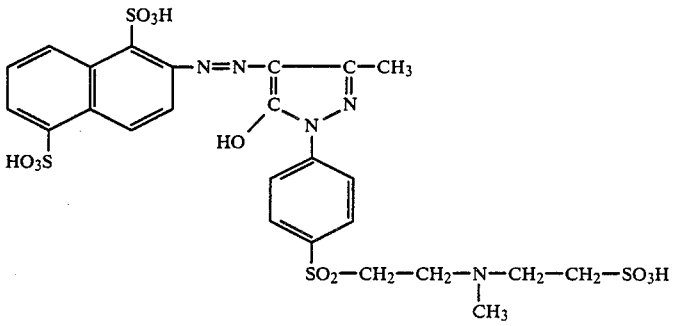

0.5% of a reactive dye obtained by conversion of the corresponding dye of the vinylsulfonyl type with N-methyltaurine and having the formula

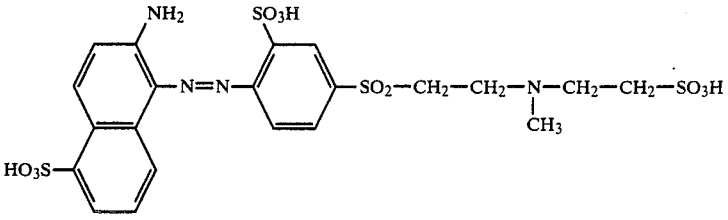

0.5% of a reactive dye obtained by conversion of the corresponding dye of the vinylsulfonyl type with N-methyltaurine and having the formula,

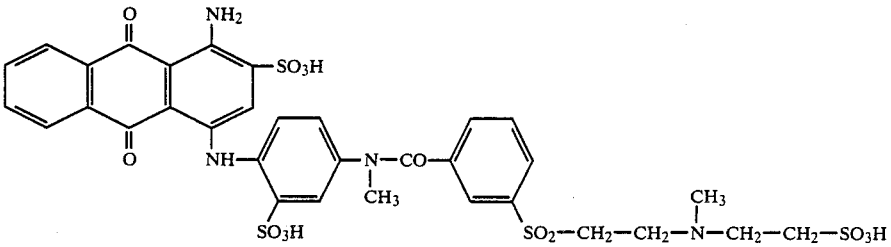

1.5% of the assistant mixture of Example 1, and

2% of ammonium acetate, the bath is raised to the dyeing temperature of 106° C. in the course of 15 minutes, and the continuous, program-controlled acid metering is started immediately with the proviso that, under the stated temperature conditions, this liquor has added to it 3 liters of 60% strength acetic acid, diluted with water to a volume of 30 liters, in the course of a period of 45 minutes by progressively increasing the amount added per unit time by 60%.

After all the acid has been metered in, the material is dyed at 106° C. for a further 10 minutes, is then cooled down together with the liquor, is rinsed with water and is finished in a manner customary for wool.

The result obtained is a very good level brown slubbing.

We claim:

1. A process for the level dyeing of wool or of the wool portion of fiber blends by the exhaust dyeing technique in a weakly acidic medium with aqueous liquors of reactive dyes, which comprises heating the exhaust liquor which contains such dyes, but no acid or acid-donating agent required for fixing the dyes, together with the material to be dyed to the dyeing temperature within the range from 95° to 106° C. as rapidly as possible and in one step, then, on reaching the dyeing temperature and while maintaining appropriate isothermal conditions for dye fixation, adding acid to the hot dyebath incrementally, within a period of 15 to 60 minutes, and dyeing the wool at pH values between 4 and 6.5.

2. The process as claimed in claim 1, wherein the addition of all the acid is effected discontinuously in constant amounts at constant intervals.

3. The process as claimed in claim 1, wherein the addition of all the acid is effected continuously in a constant amount per unit time.

4. The process as claimed in claim 1, wherein the addition of all the acid is effected discontinuously in increasing amounts at constant intervals.

5. The process as claimed in claim 1, wherein the addition of all the acid is effected continuously in an increasing amount in accordance with a time schedule corresponding to a mathematical function.

6. The process as claimed in claim 1,
wherein the treatment time of the wool at the dyeing temperature is in total between 60 and 90 minutes.

7. The process as claimed in claim 1,
wherein wool which has not been pretreated with an antifelting finish is dyed.

8. The process as claimed in claim 1,
wherein wool which has been pretreated by chlorination or been given a low- or non-felting finish by application of a polyimine resin or of a polyacrylic resin is dyed.

* * * * *